US005461813A

United States Patent [19]

Mazzola

[11] Patent Number: 5,461,813

[45] Date of Patent: Oct. 31, 1995

[54] AIR COIL

[76] Inventor: Anthony H. Mazzola, P.O. Box 424, Birmingham, Ala. 35124

[21] Appl. No.: 105,678

[22] Filed: Aug. 13, 1993

[51] Int. Cl.[6] ..... F41C 23/08

[52] U.S. Cl. ..... 42/74

[58] Field of Search ..... 42/74, 71.01

[56] References Cited

U.S. PATENT DOCUMENTS

| | | | |
|---|---|---|---|
| 699,608 | 5/1902 | Winters | 42/74 |
| 1,246,117 | 11/1917 | Krueger | 42/74 |
| 1,328,924 | 1/1920 | Kennedy | 42/74 |
| 3,037,313 | 5/1962 | Gring, Jr. | 42/74 |
| 3,491,473 | 1/1970 | Eastin | 42/74 |
| 3,514,989 | 6/1970 | Pachmayr | 42/74 |
| 3,574,965 | 4/1971 | Seiger | 42/96 |
| 3,669,325 | 6/1972 | Furman | 224/243 |
| 4,683,671 | 8/1987 | Farrar | 42/74 |

FOREIGN PATENT DOCUMENTS

| | | | |
|---|---|---|---|
| 252899 | 10/1912 | Germany | 42/74 |

OTHER PUBLICATIONS

Reebok Catalogue, pp. 1–2, no date.

*Primary Examiner*—Stephen M. Johnson

[57] ABSTRACT

A recoil pad for a shoulder gun such as a rifle or shotgun having a compressible pad on the butt of the stock to absorb and cushion the shock to the shooter when the gun is fired. This recoil pad may be assembled to the gun at manufacture or applied to the gun by the owner after-market. This recoil pad may be constructed of an elastomeric material such as closed-cell-foam containing a compressible fluid such as air or gas. An alternative embodiment is a bladder and a pump for inflation of the recoil pad at the will of the shooter. Another alternative is a bladder having a certain pressure.

2 Claims, 1 Drawing Sheet

AIR COIL

BACKGROUND OF THE INVENTION

1. Field of the Invention

My invention relates generally to shoulder guns and more particularly to a recoil pad attached to the gun stock at the butt end to cushion and absorb the recoil energy produced when the projectile is fixed out the muzzle of the gun. The recoil pad compresses to distribute the recoil energy over a large area of the shoulder to avoid pain and bruising to the shooter.

2. Description of the Prior Art

Recoil pads for shotguns and rifles to cushion the recoil forces to the shoulder of the shooter are well known in the prior art. These known recoil pads have been found to not be completely satisfactory for a number of reasons. Their physical design does not distribute the recoil forces sufficiently. The material used to make them is not of the proper durometer hardness and thus not conducive to cushion and thus conform to the shape of the shoulder. The elastomeric material was subject to deterioration with time and use in the field. Numerous attempts to solve this problem have been made by inventions such as:

The patent to Pachmayr, U.S. Pat. No. 3,609,903 is the most widely known recoil pad, made of one piece red rubber and having webs that form self springs. The material deteriorates and hardens with age. Further this pad does not spread out to disperse the pressure of the recoil to the shoulder.

The patent to Webb, U.S. Pat. No. 3,696,544 discloses a recoil pad comprising an open-cell foam material and fluid enclosed in a flexible container on the butt of the gun stock. This recoil material is likened to a sponge in a non-compressible fluid such as water or oil. This combination will conform to the shoulder but will not absorb the shock of recoil.

These aforementioned patents have the obvious deficiency of not being able to absorb the forces of recoil of the shoulder guns by distributing the forces over a broad area and thereby cushioning the recoil.

SUMMARY OF THE INVENTION

Briefly the instant invention overcomes the disadvantages of the prior art by providing a recoil pad on the butt of the stock of shoulder guns comprising a system of closed-cell material such as Polyurethane or Ensolite® wherein the closed cells contain a compressible fluid such as air or an inert gas such as nitrogen which deforms to the reaction recoil to the shape of the shoulder.

The most generalized form of my invention comprises a recoil absorbing pad affixed to the butt end of the stock of a shoulder gun such as a rifle or shotgun. In competition trap and skeet shooting using clay pigeons, many shots are fired in sequence producing fatique, bruising to the shoulder and therefore reluctance to continue shooting and also inaccuracy of the shot.

An important feature of this invention is the structure and material used in the recoil pad. The pad should contain a compressible fluid such as air or an inert gas and not a liquid. Pressures for acceptable firmness or flaccidness range from 0–20 psi so that the pad will compress and conform to the shoulder to distribute the pressure shock of recoil. One embodiment provides adjustable pressurization at the will of the user.

In actual experimentation, it was found that there was considerable difference in the "kick" or recoil pressure of various combinations of powder charges and projectiles. For example, a 12 gauge 3" Magnum shotgun shell loaded with #3 lead shot or 00 buckshot, a 7 mm Remington Magnum rifle, and a 0.270 cal. rifle were test-fired. The varying recoils of each of the shoulder arm and load and projectile combinations can be compensated for by the shooter by varying the pressure in the recoil pad according to the desire of the shooter.

One embodiment of the instant invention utilizes a foam having closed cells roomed to a proper desired shape secured to a plate which is subsequently attached to the gunstock butt. A shaped cover made of leather or plastic film to envelope the foam is utilized so as to protect it. This embodiment preferably may be made in one piece with the sponge pad molded integral with a self-skin such as is found in automobile interior padding for crash protection of the occupants. This assembly may be adhered to a plate with any known adhesive for attachment to the gunstock butt by fasteners.

Another embodiment comprises a bladder that may be segmented for controlably distributing the inflation pressure to resist the recoil shock. The pressure may range from 0–20 psi and is controlled by the user with a manual pump. This combination of a bladder and pump is well-known for use in air casts, athletic shoes, and ski boots. The Instapump by Reebok is the best example of the valve 24 integral with the bladder, and the associated CO2 pressurizing pump (not shown) that will be applied to the valve 24 to change the recoil pressure.

A modification of the bladder embodiment is a sealed cavity or bladder containing a fluid and having a fixed pressure and permanently sealed. The fluid may comprise a compressible gas such as nitrogen or air. The bladder may be one cell or chambered to provide controlled flow between cells. Furthermore the fluid may be a combination of a compressible fluid and a non-compressible fluid such as mineral oil much like is used in stereo headphones having ear-surrounding muffs.

This invention is the subject of my Document Disclosure No. 326175.

STATEMENT OF THE OBJECTS OF THE INVENTION

Accordingly, an object of the instant invention is to provide a recoil pad having a bladder of one or more chambers containing a compressible fluid.

Still another object of the invention is to provide a recoil pad having a cavity that may be pressurized to a pressure of 0 to 20 psi at the will of the shooter.

A further object of the instant invention is to provide a recoil pad having a sealed bladder containing a compressible fluid of a certain fixed pressure.

A still further object of the instant invention is to provide a recoil pad comprising a closed-cell foam filled with a compressible fluid.

A still further object of the invention is to provide a recoil pad utilizing materials such as Sorbethane®, Ensolite®, or the like, having specific characteristics that cushion the shoulder from the forces of recoil.

An additional object of the instant invention is to provide a recoil pad for a shoulder gun having a protective covering of leather, or plastic simulated leather.

BRIEF DESCRIPTION OF THE DRAWING

These and other objects, advantages, and novel features of the invention will become more apparent when considered in conjunction with the accompanying drawing wherein.

DESCRIPTION OF THE PREFERRED EMBODIMENT

Figure 1:
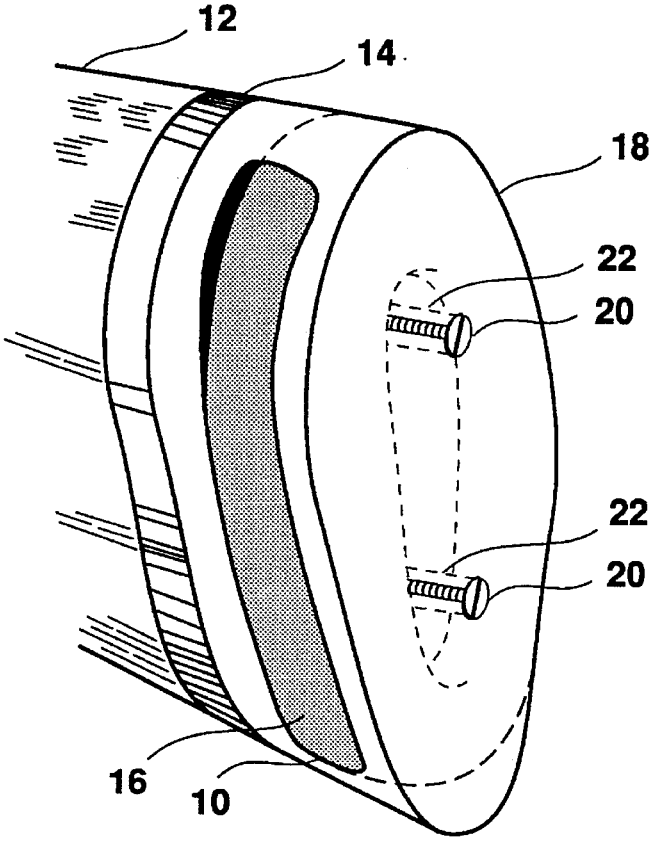
FIG. 1 is a pictorial perspective view of a shoulder gunstock with the recoil pad of a closed-cell structure affixed thereto.

Referring now to the drawing, wherein like reference numbers refer to the same parts throughout the several views, there is shown generally in FIG. 1, a recoil pad 10 attached to a gun stock butt 12. The recoil pad 10 comprises a plate 14 directly adjacent the gun butt, a closed-cell foam pad 16 and a cover 18.

The recoil pad 10 is affixed to the gun stock butt with wood screws 20 through counter-bored apertures 22. The plate 14 may be made of a light rigid material such as phenolic, polyurethane, nylon or the like and be approximately ⅛" to 3/16" thick. The outer peripheral edge of the plate should conform to the existing stock butt for esthetics. The cover may be made of flaccid leather or a substitute and be substantially cup-shaped to surround the entirety of the pad 10 and be adhered to the periphery of the plate 14 with any known durable adhesive.

FIG. 1 shows a first embodiment of the pad made of closed cell foam. Foams are manufactured by mixing at least two chemicals in a mold of the desired configuration. The cells may be made any size and the material surrounding the cells may be any durometer hardness as desired. Some exotic foams have variable density across the cross-section of the recoil pad. For example automobile seat cushions and dashboards and other inside padding is a closed-cell foam with an integral skin with various textures embossed and having various colors.

Figure 2:
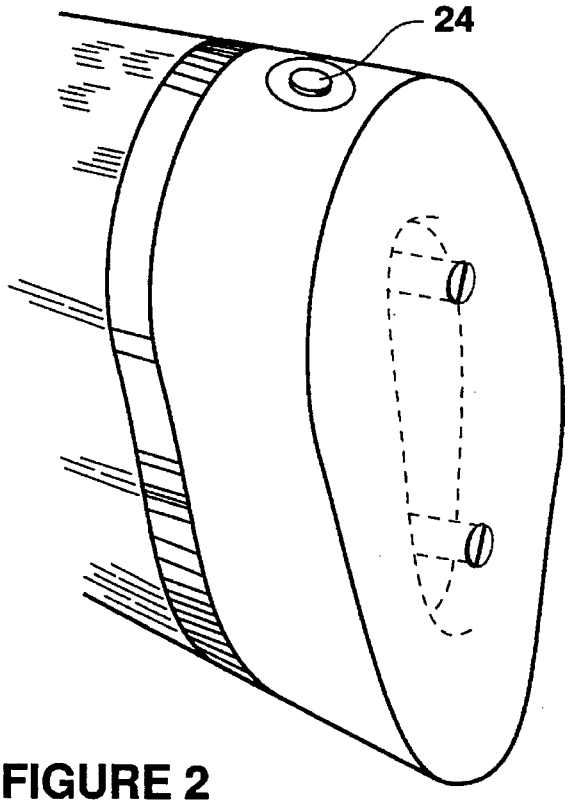
FIG. 2 is a pictorial perspective view of a shoulder gun with the recoil pad comprising a bladder and pump construction.

FIG. 2 shows another embodiment of the instant invention comprising a chambered bladder 16 with an inflation valve 24. The inflation valve 24 is integrally molded to the bladder 16 to facilitate pressure adjustment. Typical prior art examples of this system are basketball shoes, ski boots, and air splints. In particular, the Instapump manufactured by Reebok is a CO2 charged pump that is applied to the valve 24 which is integral with the bladder 16. A cover 18 in the form of a cup conforms to the pad 10 and is adhered to the peripheral edge of the plate 14 and may be made of leather or othe flaccid material. The cover serves to protect the bladder and presents an esthetic appearance. This alternative approach using bladder and pump is desireable to the shooter. The internal pressure can be adjusted as desired to compensate for the recoil pressures developed by various powder loads and bullet weights fired.

Obviously, numerous modifications and variations of the present invention are possible in light of the above teachings. It is therefore to be understood that, within the scope of the appended claims, the invention may be practiced otherwise than as specifically described.

What I claim for letters patents is:

1. A recoil pad for a shoulder gun comprising:

a flat plate attached to the butt of said gun;

a surrounding elastic cover adhered to the peripheral edge of said plate;

a resilient deformable bladder surrounded by said elastic cover and located between said plate and said cover; and;

a valve formed in said resilient deformable bladder capable of admitting and releasing pressure in said bladder.

2. The recoil pad of claim 1 wherein: a pump with a $CO_2$ cartridge may be applied to said valve to increase the pressure in said bladder.

* * * * *